US006902064B2

(12) United States Patent
Wang et al.

(10) Patent No.: US 6,902,064 B2
(45) Date of Patent: Jun. 7, 2005

(54) PACKAGING FOR GROUPED SIMILAR ITEMS, INCLUDING ELONGATED ITEMS SUCH AS DRILL BITS AND THE LIKE

(75) Inventors: Yuhong Wang, Shanghai (CN); Robert Erkes, St. Charles, IL (US)

(73) Assignee: TG Tools United Company, St. Charles, IL (US)

( * ) Notice: Subject to any disclaimer, the term of this patent is extended or adjusted under 35 U.S.C. 154(b) by 0 days.

(21) Appl. No.: 10/685,920

(22) Filed: Oct. 15, 2003

(65) Prior Publication Data

US 2005/0082190 A1 Apr. 21, 2005

(51) Int. Cl.[7] ..... B65D 75/38

(52) U.S. Cl. ..... 206/730; 206/379; 206/459.5; 206/806; 383/38; 383/109

(58) Field of Search ..... 206/730, 379, 206/443, 459.5, 778, 484.2, 497, 806; 383/38–40, 383/109

(56) References Cited

U.S. PATENT DOCUMENTS 2,788,121 A * 4/1957 Ayres ..... 206/778
3,307,686 A * 3/1967 Brecher ..... 206/232
3,638,784 A * 2/1972 Bodolay et al. ..... 206/459.5
3,762,628 A * 10/1973 Sargent ..... 383/40
3,844,409 A * 10/1974 Bodolay et al. ..... 206/459.5
3,939,972 A * 2/1976 Mayworm ..... 206/219
4,744,673 A * 5/1988 Nakamura ..... 383/38
5,024,536 A * 6/1991 Hill ..... 383/38
5,881,883 A * 3/1999 Siegelman ..... 206/720

OTHER PUBLICATIONS

Photo of package for Weller Tip Solder, sold at least as early as Oct. 1, 2002.
Photo of package for Wolfcraft Shaker Pegs, sold at least as early as Oct. 1, 2002.
Photo of package for RotoZip Bits, sold at least as early as Oct. 1, 2002.
Photo of package for DeWalt driver bits, sold at least as early as Oct. 1, 2002.
Photo of package for Bosch drill bits, sold at least as early as Oct. 1, 2002.

* cited by examiner

*Primary Examiner*—Mickey Yu
*Assistant Examiner*—Jerrold Johnson
(74) *Attorney, Agent, or Firm*—Greenberg Traurig

(57) ABSTRACT

A package for like articles, especially elongated articles, such as drill bits and the like, is provided with a plurality of compartments or sectioned off regions, for the containment of an individual article for substantially unfettered visual inspection; for the containment of a further plurality of articles identical to the exposed visual article, and for indicia as required by the manufacturer and/or required by law. The package is configured to be presented in a hanging manner from retail display shelving.

20 Claims, 4 Drawing Sheets

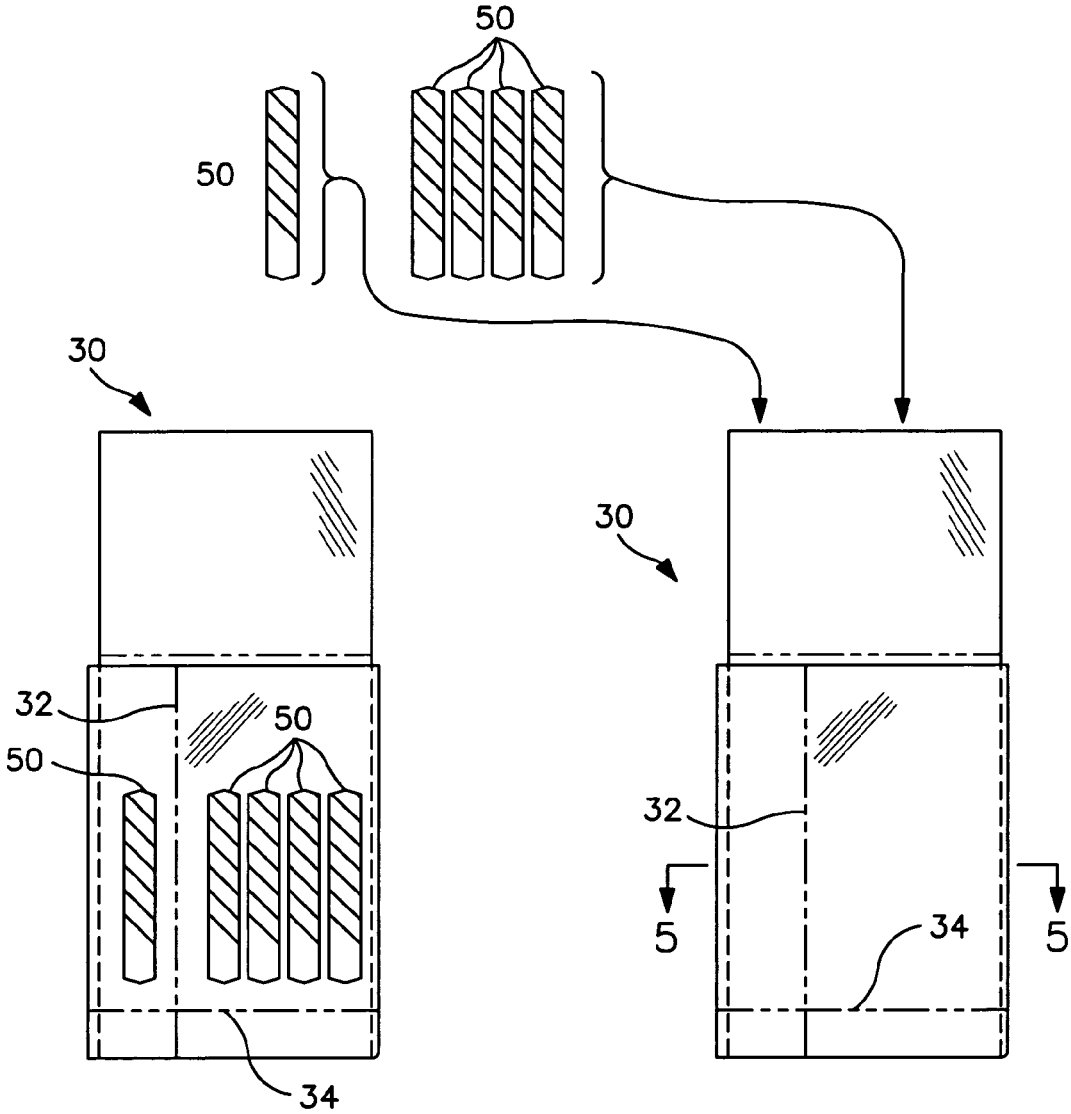
FIG. 6
FIG. 4
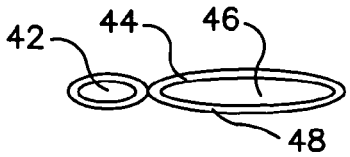
FIG. 5

PACKAGING FOR GROUPED SIMILAR ITEMS, INCLUDING ELONGATED ITEMS SUCH AS DRILL BITS AND THE LIKE

BACKGROUND OF THE INVENTION

1. The Technical Field

The present invention is directed to packaging for grouped similar items, including elongated items such as drill bits or the like, and further including packaging adapted to be hung from retail shelving.

2. The Prior Art

There are many ways to package and present in a retail environment, elongated items, such as drill bits, jigsaw blades and the like, including skin cards, clamshell blister packs, plastic bags, and molded or stamped boxes. Such elongated items may be sold in a variety of basic ways: the single article (or at most 2–3 if small) in a package; a quantity of, e.g. 5–10 identical articles in a package; an organized set of different, but related articles (e.g., a set of an indeterminate number of articles of varying size, grade, etc.).

Presenting a single article in a package may be advantageous, in that in a transparent package, e.g., a bag or skin card, all or substantially all of the surface of the individual article may be exposed for visual inspection or even (in a thin bag or wrapper) tactile inspection.

However, single article packaging can be problematic in that it can occupy more storage and shipping volume that a comparable number of like articles packaged in bunches. Furthermore, if a customer is purchasing a large quantity of single articles, there can be more checkout time involved.

However, plural article packaging can be problematic as well, for elongated articles such as drill bits and the like. Such packaging may typically may be fabricated from plastic or paper. Plastic may be difficult to affix identifying and marketing indicia, consumer information and the like in a manner which does not obscure the visibility of the products inside. Paper may permit indicia placement but likewise typically obscures visibility of the articles being presented.

It would be desirable to provide a method for packaging plural identical articles, such as elongated articles like drill bits, which has the advantages of single article packaging, such as enabling visual inspection of the articles.

It would also be desirable to provide a method for packaging of plural identical articles, which provides for the placement of such indicia as may be desired by the manufacturer or required by law, while still permitting visual inspection.

These and other desirable characteristics of the present invention will become apparent in view of the present specification, including claims, and drawings.

SUMMARY OF THE INVENTION

The present invention comprises in part, a package of a plurality of like articles, having a longitudinal axis and a transverse axis. The package comprises a first sleeve, having a length, a top end and a bottom end; and a second sleeve, insertingly received within the first sleeve and having a length greater than the length of the first sleeve, a top end and a bottom end, so that the first sleeve overlaps at least a portion of the second sleeve in a region of overlap.

A first closure line extends along at least a portion of the region of overlap. The first closure line joins longitudinally extending inner surfaces of the first sleeve to adjacent longitudinally extending outer surfaces of the second sleeve, and opposing longitudinally extending inner surfaces of the second sleeve to each other.

A second closure line extends transversely across at least a portion of the region of overlap. The second closure line joins transversely extending inner surfaces of the first sleeve to adjacent transversely extending outer surfaces of the second sleeve, and opposing transversely extending inner surfaces of the second sleeve to each other.

The first and second closure lines define first and second chambers in the second sleeve, the first chamber being larger than the second chamber, and third and fourth chambers between the first and second sleeves, on opposite sides of the first chamber in the second sleeve.

A plurality of articles are disposed in the first chamber, and a single article is disposed in the second chamber.

A third closure line extends transversely across the second sleeve in a region beyond the region of overlap, and joins transversely opposing inner surfaces of the second sleeve, with the plurality of articles and the single article being disposed between the second and third closure lines, to maintain the plurality of articles and the single article captured within the first and second chambers, respectively.

In a preferred embodiment of the invention, each of the first and second sleeves is one of: transparent, translucent.

The package preferably further comprises at least one sheet disposed in at least one of the third and fourth chambers disposed between the first and second sleeves, on opposite sides of the first chamber in the second sleeve. The at least one sheet preferably has indicia disposed thereon.

The package preferably further comprises a reinforcement sheet juxtaposed against a surface of the second sleeve, proximate the top thereof; and an aperture formed through the second sleeve and the reinforcement sheet, for enabling the package to be suspended by a member passing through the aperture.

Preferably, the top end of the second sleeve is longitudinally spaced apart from the top end of the first sleeve. The bottom end of the second sleeve is preferably disposed proximate the bottom end of the first sleeve. The second sleeve preferably has a width which is less than the width of the first sleeve.

The plurality of articles disposed in the first chamber are preferably all like articles, and the single article disposed in the second chamber is the same as one of the plurality of like articles. Preferably, the first and second sleeves comprise substantially flattened tubes.

The present invention also comprises, in part, a method for forming a package, the package having a longitudinal axis and a transverse axis. The method comprising the steps of:

- forming a first sleeve, having a length, a top end and a bottom end;
- forming a second sleeve, having a length greater than the length of the first sleeve, a top end and a bottom end;
- inserting the second sleeve into the first sleeve, so that the first sleeve overlaps at least a portion of the second sleeve in a region of overlap;
- forming a first closure line, extending along at least a portion of the region of overlap, to join longitudinally extending inner surfaces of the first sleeve to adjacent longitudinally extending outer surfaces of the second sleeve, and opposing longitudinally extending inner surfaces of the second sleeve to each other;
- forming a second closure line, extending transversely across at least a portion of the region of overlap, to join transversely extending inner surfaces of the first sleeve to adjacent transversely extending outer surfaces of the second sleeve, and opposing transversely extending inner surfaces of the second sleeve to each other;

the first and second closure lines defining first and second chambers in the second sleeve, the first chamber being larger than the second chamber, and third and fourth chambers between the first and second sleeves, on opposite sides of the first chamber in the second sleeve;

placing a plurality of articles in the first chamber;

placing a single article in the second chamber;

forming a third closure line, extending transversely across the second sleeve in a region beyond the region of overlap, to join transversely opposing inner surfaces of the second sleeve, with the plurality of articles and the single article being disposed between the second and third closure lines, to maintain the plurality of articles and the single article captured within the first and second chambers, respectively.

The steps of forming the first and second sleeves, preferably further comprise the step of forming each of the first and second sleeves from one of transparent or translucent material.

The method preferably further comprises the step of:

placing at least one sheet in at least one of the third and fourth chambers disposed between the first and second sleeves, on opposite sides of the first chamber in the second sleeve.

The method preferably further comprises the step of placing indicia on the at least one sheet.

The method preferably further comprises the steps of:

juxtaposing a reinforcement sheet against a surface of the second sleeve, proximate the top thereof; and forming an aperture through the second sleeve and the reinforcement sheet, for enabling the package to be suspended by a member passing through the aperture.

The method preferably further comprises the step of:

positioning the top end of the second sleeve in longitudinally spaced apart relation to the top end of the first sleeve.

The method preferably further comprises the step of:

positioning the bottom end of the second sleeve proximate the bottom end of the first sleeve.

The method preferably further comprises the step of:

forming the second sleeve with a width which is less than the width of the first sleeve.

The method preferably further comprises the steps of:

selecting the plurality of articles disposed in the first chamber to be all like articles, and selecting the single article disposed in the second chamber to be the same as one of the plurality of like articles.

Preferably, the first and second sleeves are formed as substantially flattened tubes.

BRIEF DESCRIPTION OF THE DRAWINGS

FIG. 4 is an elevation of the assembly of FIG. 3, shown further along the fabrication process.

FIG. 5 is a sectional view of the assembly of FIG. 4, taken along line 5—5 of FIG. 4.

FIG. 6 is an elevation of the assembly of FIG. 4, showing the insertion of elongated articles into respective receiving chambers of the package in formation.

DETAILED DESCRIPTION OF THE INVENTION

Figure 1:
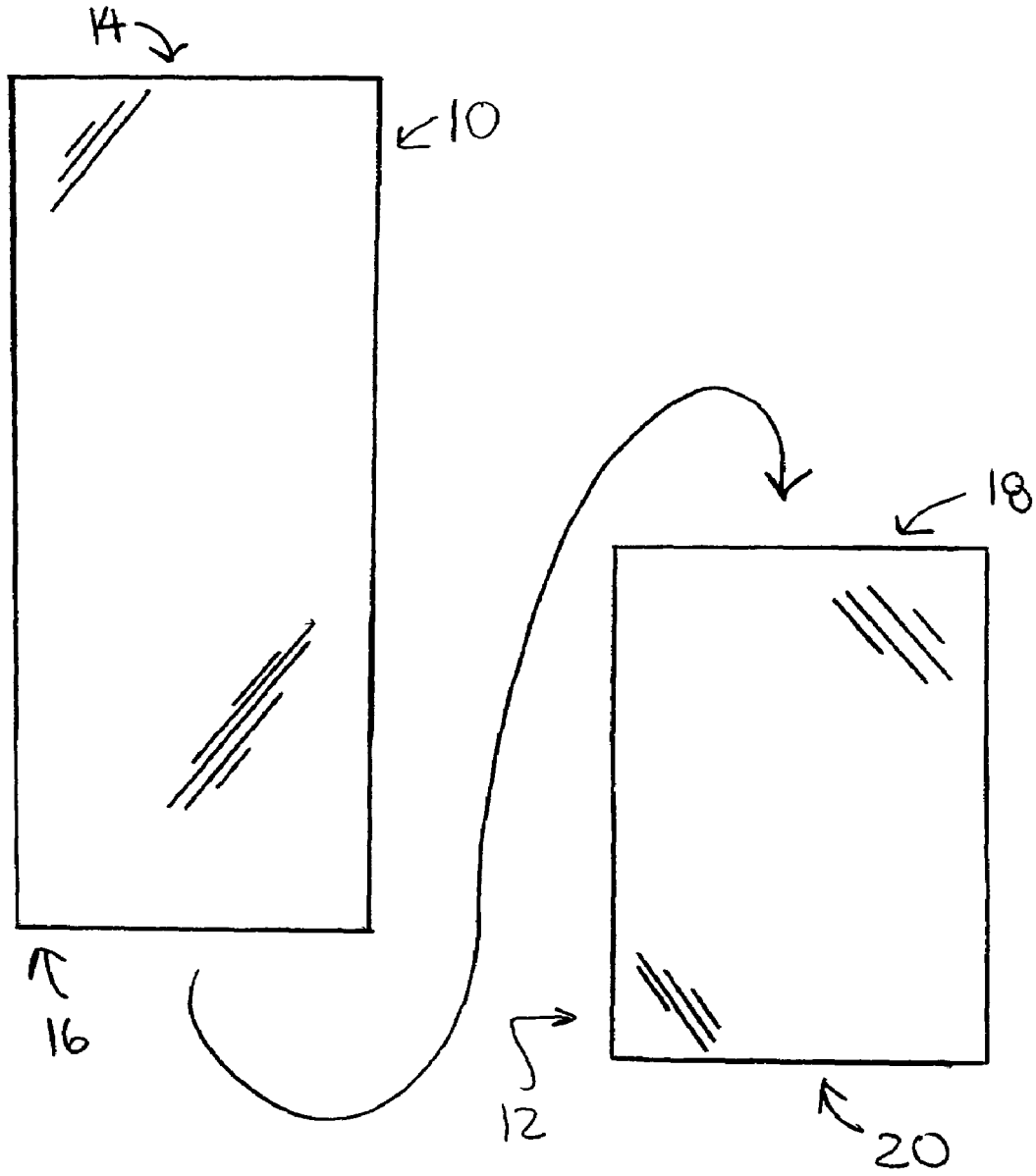
FIG. 1 is an elevation of two components of a package for similar articles, according to a preferred embodiment of the invention.
Figure 2:
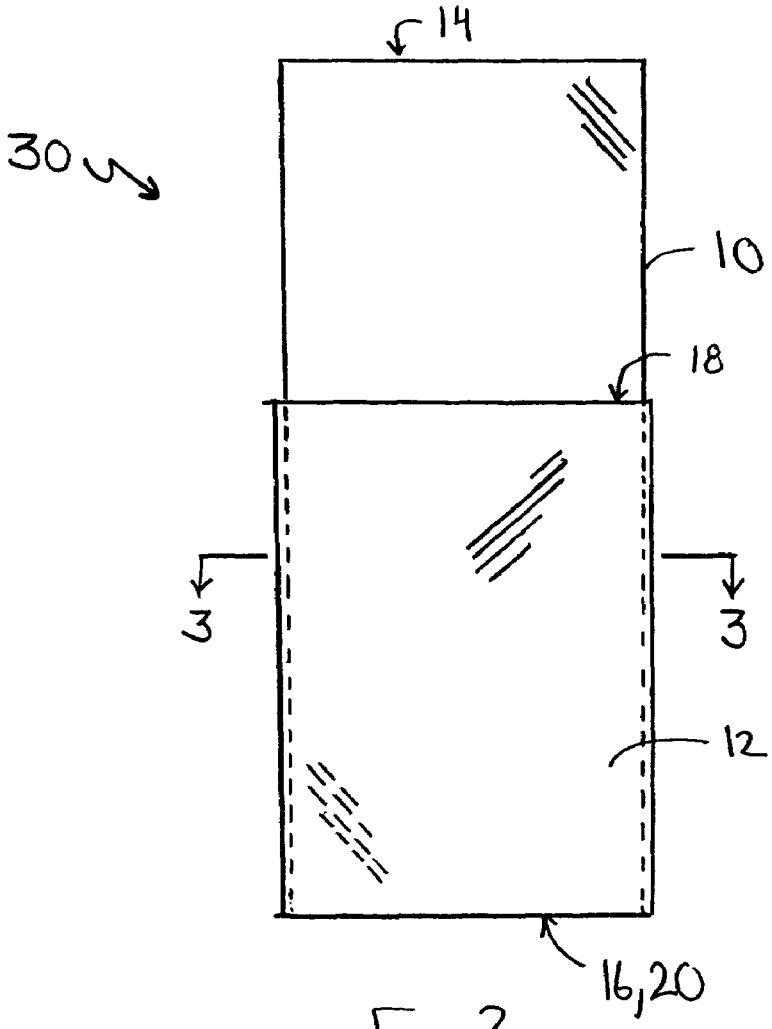
FIG. 2 is an elevation of the two components of FIG. 1 in partially assembled configuration.
Figure 3:
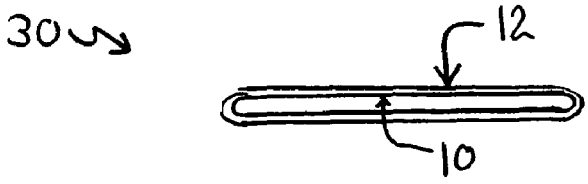
FIG. 3 is a sectional view of the assembly of FIG. 2, taken along line 3—3 of FIG. 2.

While this invention is susceptible of embodiment in many different forms, there is shown in the drawings and will be described in detail several specific embodiments, with the understanding that the present disclosure is to be considered an exemplification of the principles of the invention and is not intended to limit the invention to the embodiments illustrated.

A package for a plurality of similar articles according to a preferred embodiment of the invention is formed first, as shown in FIG. 1, by forming two sleeves 10 and 12, each of which is preferably formed (e.g., by cutting to desired length), tubular plastic material (of any suitable type—typically cut from a roll of flattened tube), which are preferably transparent, or alternatively translucent, but which will permit visual inspection of anything within the respective sleeves. The plastic which forms sleeves 10 and 12 may be of any kind, so long as it exhibits suitable heat, pressure, or sonic sealing capability.

Sleeve 10 includes open ends 14 and 16, while sleeve 12 includes open ends 16 and 18. The material of sleeves 10 and 12 is preferably susceptible to welding to itself, e.g., by pressure, heat, microwave or ultrasonic vibrations. Sleeve 10 is inserted into sleeve 12 which preferably has a circumference which is slightly greater than the circumference of sleeve 10, in order to facilitate the insertion of sleeve 10 into sleeve 12. Alternatively, sleeve 10 may have a circumference that is the same as or greater than that of sleeve 12, though this may make insertion of sleeve 10 into sleeve 12 more difficult, as well as making later fabrication steps slightly more difficult. In addition, sleeve 10 has a length which is preferably substantially greater than the length of sleeve 12.

Upon insertion, sleeves 10 and 12 form assembly 30, in which open end 16 of sleeve 10 is preferably substantially aligned with the end 20 of sleeve 12, although the respective ends may be unaligned if desired.

The third stage of the package formation occurs when welds 32 and 34 are provided, extending through both sleeves 10 and 12, to form assembly 40, creating chambers 42, 44, 46, and 48. Weld 34 closes off the bottoms 16 and 20 of sleeves 10, 12, respectively, while weld 32 creates a vertical separation of the volume within sleeve 10. Preferably, weld 32 is off-center, so that chamber 42 is appropriately sized for a single article 50, while chamber 46 is appropriately sized to receive a plurality of like articles 50.

Although chambers 44, 48 are, strictly speaking, contiguous, because of the fact that they are, due to the typically flattened nature of sleeves 10, 12, on generally opposite sides of chamber 46, it is useful to consider them as separate and discrete chambers. In instances in which the bulk of the articles being packaged causes the package to assume a less than flattened configuration, it may be desirable to provide further welds, extending longitudinally at the sides of the region of overlap of tubes 10, 12, so that fully discrete and discontinuous chambers are created.

While welds, as described above are preferably used to create the separations between the various chambers, of the package described herein, as being the most efficient and amenable to manufacturability, other methods of creating the welds (or closure lines) may be employed, such as staples or stitching, for example. Further, the welds or closure lines, while preferably extending continuously and completely across the height or width of the respective sleeves to which they are applied, may instead be intermittent, and may stop short of peripheral edges of the respective sleeves or at other locations, so long as the function of restraining the articles being packaged within their respective regions is accomplished.

Articles 50 are inserted into chambers 42, 46, after welds 32, 34 have been accomplished. Articles 50 are shown representationally as drill bits, but may be any elongated articles (e.g., center punches, etc.). Even non-elongated articles may be accommodated, by suitably modifying the relative dimensional proportions of the chambers created by the overlapped sleeves and the subsequently created welds.

After the articles 50 have been inserted, they are sealed in place by weld 52, which extends across sleeve 10, but does not contact the top of sleeve 12, thus leaving the tops of chambers 44, 48 still open, and as well leaves the top of sleeve 10, above weld 52, likewise open for insertion of further items. Sheets 54, 56 may be provided with various indicia (product name, product information, UPC bar code (s), etc.) as desired or required by law. Sheets 54, 56 may be fabricated from any suitable material capable of bearing indicia, and once prepared and suitably printed, are inserted into chambers 44, 48, respectively.

Figure 7:
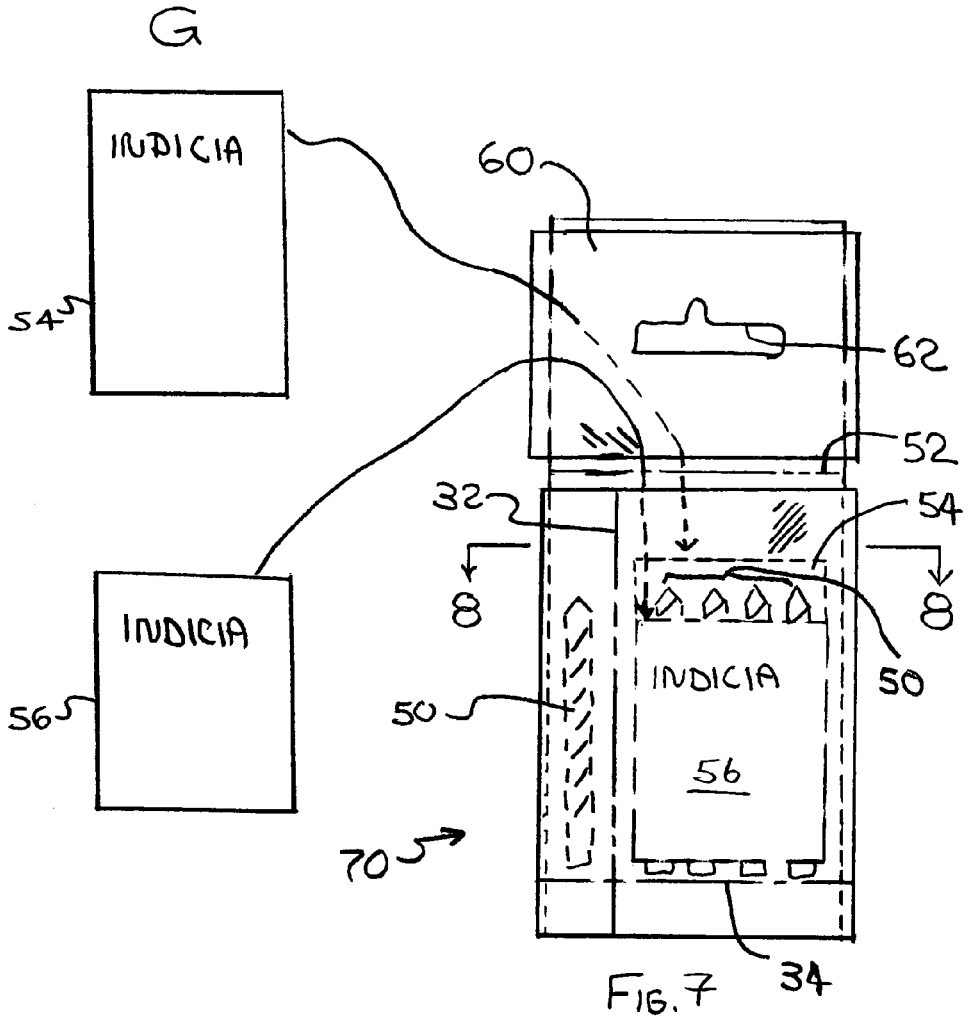
FIG. 7 is an elevation of the assembly of FIG. 6, showing the insertion of indicia bearing sheets, as well as a reinforcement sheet for enabling the hanging display of the package.
Figure 8:
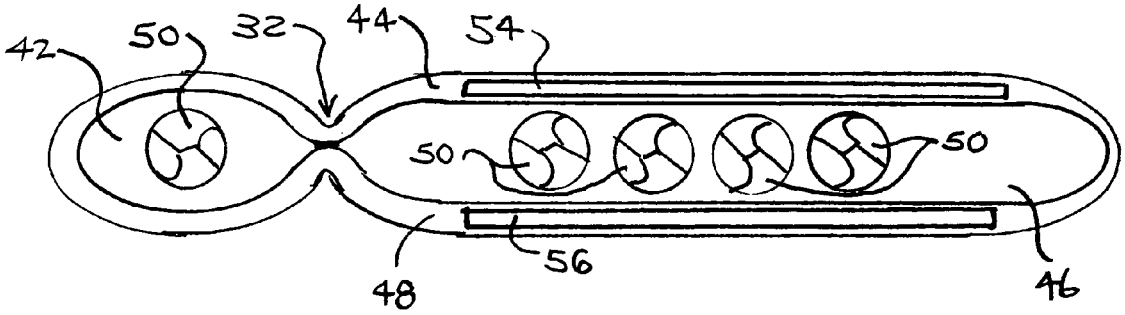
FIG. 8 is an enlarged sectional view of the assembly of FIG. 7, taken along line 8—8 of FIG. 7.

As the side shown in FIG. 7 is preferably the nominal "front" of the package, it is intended to be placed on a shelf, so that sheet 56 faces front. Sheet 56 preferably is "shorter" than the articles 50 (e.g., drill bits), so that the tops of the articles will be visible, while sheet 54 may or may not be of equal or greater length than articles 50. Sheet 54 will be rotated 180 degrees (as indicated by the arrow), so that its indicia face to the rear (although either sheet may be provided with indicia on both sides, as necessary or desired).

Once sheets 54, 56 have been inserted, a further weld may be placed across the tops of chambers 44, 48. However, in usual practice this may not be necessary, as sheets 54, 56 will be sized so that the fit of each within its respective chamber 44, 48 will be sufficiently snug enough that sheets 54, 56 will not fall out, subsequent to fabrication, to prevent sheets 54, 56 from being dislodged during shipment, through placement on retail shelving, up to purchase by a consumer.

The placement of sheets 54, 56 in the chambers 44, 48, rather than immediately adjacent to articles 50 is advantageous, in that articles 50, which may be, e.g., drill bits or other tool parts, may be coated with oil or other materials, for example, to prevent rusting or other damage to the articles, pending purchase by the consumer. This coating may be harmful or detrimental to the indicia that is printed on the sheets, in that it may blur the printing or adversely affect the material of the sheets themselves. By placing the sheets 54, 56 within chambers 44, 48, they are isolated from the articles, and cannot be affected by them or any coating or the like.

After placement of the sheets, and possible, though not required, welding of the tops of chambers 44, 48, the package is then prepared for hanging. Depending upon the strength of the material, the top of sleeve 10 may be simply closed by a further weld.

Preferably, a further sheet 60, which is likewise preferably of a suitable plastic material, is affixed directly to the outside (preferably, the front) of the top end of tube 10 by, e.g., pressure, heat or sonic welding, which produces a weld over the entire surface of contact between sheet 60 and tube 10. When affixed to the outside of tube 10, preferably sheet 60 is actually wider than the top of tube 10, to ensure a solid surface to surface contact. Sheet 60 may be substantially thicker than that of tube 10. Sheet 60 is used to provide reinforcement to the material of tube 10, to enable an aperture to be formed in the top of tube 10, to permit hanging by a rod, peg or hook. Sheet 60 will preferably be fabricated from a heat or sonically sealable material, and will be affixed to tube 10 in that manner, which may have the additional effect of welding opposing portions of the top of tube 10. Alternatively, sheet 60, if suitably sized, may be inserted into the top of tube 10.

Once sheet 60 is in place, a suitable aperture 62 may be formed, such as by die-cutting, through sheet 60 and the juxtaposed layers of tube 10, to enable package 70 to be hung by a peg, rod or hook from a retail display shelving unit.

Alternatively (not shown), a sheet (which may be of any material and which may or may not also have indicia placed on it) may be inserted into tube 10 above weld 52 to provide reinforcement strength for enabling the package to be hung on a peg, rod or hook. A final weld may be formed in tube 10 above the inserted sheet. Once in place, an aperture similar to aperture 62 is formed through the layers of sleeve 10 and the inserted sheet, in any suitable shape that is appropriate for enabling the completed package 70 to be hung via a peg or hook, from a retail display shelf. Depending upon the characteristics of the particular materials from which sleeve 10 and the inserted sheet are fabricated, the act of die-cutting the aperture may serve to press onto or microweld the layers of sleeve 10 to the sides of sheet 60, proximate to hole 62, so that the edges of sleeve 10 that define hole 62 are not loose, but more or less affixed to sheet 60.

A further vertical weld 64 may be provided if desired, to prevent sheet 60 from migrating laterally, and to obviate the need for sheet 60 to extend across the entire width of the top of sleeve 10. Alternatively, sheet 60 may be made to have a width approximately equal to the width of sleeve 10.

Package 70 has the advantage of providing for the packaging of a plurality of like articles in a compact and economic manner, while at the same time displaying a single representative one of the articles in a complete manner for unencumbered visual inspection. Furthermore, package 70 enables indicia such as product information to be provided in a manner which is not interfered with by the articles being packaged.

While in preferred embodiments of the invention, in the package, the articles packaged are all identical or substantially so, in alternative embodiments of the invention, one or more of the articles may be non-identical.

The foregoing description and drawings merely explain and illustrate the invention, and the invention is not limited thereto, except as those skilled in the art who have the present disclosure before them will be able to make modifications and variations therein without departing from the scope of the invention.

What is claimed is:

1. A package of a plurality of like articles, having a longitudinal axis and a transverse axis, the package comprising:

a first sleeve, having a length, a top end and a bottom end;

a second sleeve, insertingly received within the first sleeve and having a length greater than the length of the first sleeve, a top end and a bottom end, so that the first sleeve overlaps at least a portion of the second sleeve in a region of overlap;

a first closure line extending along at least a portion of the region of overlap, the first closure line joining longitudinally extending inner surfaces of the first sleeve to adjacent longitudinally extending outer surfaces of the second sleeve, and opposing longitudinally extending inner surfaces of the second sleeve to each other;

a second closure line extending transversely across at least a portion of the region of overlap, the second closure line joining transversely extending inner surfaces of the first sleeve to adjacent transversely extending outer surfaces of the second sleeve, and opposing transversely extending inner surfaces of the second sleeve to each other;

the first and second closure lines defining first and second chambers in the second sleeve, the first chamber being larger than the second chamber, and third and fourth chambers between the first and second sleeves, on opposite sides of the first chamber in the second sleeve;

a plurality of articles disposed in the first chamber;

a single article, disposed in the second chamber;

a third closure line, extending transversely across the second sleeve in a region beyond the region of overlap, joining transversely opposing inner surfaces of the second sleeve, with the plurality of articles and the single article being disposed between the second and third closure lines, to maintain the plurality of articles and the single article captured within the first and second chambers, respectively.

2. The package according to claim 1, wherein each of the first and second sleeves is one of: transparent, translucent.

3. The package according to claim 1, further comprising:

at least one sheet disposed in at least one of the third and fourth chambers disposed between the first and second sleeves, on opposite sides of the first chamber in the second sleeve.

4. The package according to claim 3, wherein the at least one sheet has indicia disposed thereon.

5. The package according to claim 1, further comprising:

a reinforcement sheet juxtaposed against a surface of the second sleeve, proximate the top thereof; and an aperture formed through the second sleeve and the reinforcement sheet, for enabling the package to be suspended by a member passing through the aperture.

6. The package according to claim 1, wherein the top end of the second sleeve is longitudinally spaced apart from the top end of the first sleeve.

7. The package according to claim 1, wherein the bottom end of the second sleeve is disposed proximate the bottom end of the first sleeve.

8. The package according to claim 1, wherein the second sleeve has a width which is less than the width of the first sleeve.

9. The package according to claim 1, wherein the plurality of articles disposed in the first chamber are all like articles, and the single article disposed in the second chamber is the same as one of the plurality of like articles.

10. The package according to claim 1, wherein the first and second sleeves comprise substantially flattened tubes.

11. A method for forming a package, the package having a longitudinal axis and a transverse axis, the method comprising the steps of:

forming a first sleeve, having a length, a top end and a bottom end;

forming a second sleeve, having a length greater than the length of the first sleeve, a top end and a bottom end;

inserting the second sleeve into the first sleeve, so that the first sleeve overlaps at least a portion of the second sleeve in a region of overlap;

forming a first closure line, extending along at least a portion of the region of overlap, to join longitudinally extending inner surfaces of the first sleeve to adjacent longitudinally extending outer surfaces of the second sleeve, and opposing longitudinally extending inner surfaces of the second sleeve to each other;

forming a second closure line, extending transversely across at least a portion of the region of overlap, to join transversely extending inner surfaces of the first sleeve to adjacent transversely extending outer surfaces of the second sleeve, and opposing transversely extending inner surfaces of the second sleeve to each other;

the first and second closure lines defining first and second chambers in the second sleeve, the first chamber being larger than the second chamber, and third and fourth chambers between the first and second sleeves, on opposite sides of the first chamber in the second sleeve;

placing a plurality of articles in the first chamber;

placing a single article in the second chamber;

forming a third closure line, extending transversely across the second sleeve in a region beyond the region of overlap, to join transversely opposing inner surfaces of the second sleeve, with the plurality of articles and the single article being disposed between the second and third closure lines, to maintain the plurality of articles and the single article captured within the first and second chambers, respectively.

12. The method according to claim 11, further wherein the steps of forming the first and second sleeves, further comprises the step of forming each of the first and second sleeves from one of transparent or translucent material.

13. The method according to claim 11, further comprising the step of:

placing at least one sheet in at least one of the third and fourth chambers disposed between the first and second sleeves, on opposite sides of the first chamber in the second sleeve.

14. The method according to claim 13, further comprising the step of placing indicia on the at least one sheet.

15. The method according to claim 11, further comprising the step of:

juxtaposing a reinforcement sheet against a surface of the second sleeve, proximate the top thereof; and forming an aperture through the second sleeve and the reinforcement sheet, for enabling the package to be suspended by a member passing through the aperture.

16. The method according to claim 15, further comprising the step of:

positioning the top end of the second sleeve in longitudinally spaced apart relation to the top end of the first sleeve.

17. The method according to claim 11, further comprising the step of:

positioning the bottom end of the second sleeve proximate the bottom end of the first sleeve.

18. The method according to claim 11, further comprising the step of:

forming the second sleeve with a width which is less than the width of the first sleeve.

19. The method according to claim 11, further comprising the steps of:

selecting the plurality of articles disposed in the first chamber to be all like articles, and selecting the single article disposed in the second chamber to be the same as one of the plurality of like articles.

20. The method according to claim 11, further comprising the step of:

forming the first and second sleeves as substantially flattened tubes.

* * * * *